US006153025A

United States Patent [19]

Auran et al.

[11] Patent Number: 6,153,025

[45] Date of Patent: Nov. 28, 2000

[54] HIGH CORROSION RESISTANT ALUMINUM ALLOY CONTAINING TITANIUM

[75] Inventors: Lars Auran; Trond Furu, both of Sunndalsora, Norway

[73] Assignee: Norsk Hydro A.S., Oslo, Norway

[21] Appl. No.: 09/116,848

[22] Filed: Jul. 16, 1998

[30] Foreign Application Priority Data

Jul. 17, 1997 [EP] European Pat. Off. ..... 97202234.7
Jul. 10, 1998 [WO] WIPO ..... PCT/EP98/04957

[51] Int. Cl.[7] ..... C22C 21/00

[52] U.S. Cl. ..... 148/437; 148/438; 420/529; 420/531; 420/537

[58] Field of Search ..... 148/437, 438; 420/529, 531, 537

[56] References Cited

U.S. PATENT DOCUMENTS 4,749,627 6/1988 Ishikawa et al. ..... 428/654
5,906,689 5/1999 Sircar ..... 148/439

FOREIGN PATENT DOCUMENTS 52-63173 10/1993 Japan .
1566627 5/1980 Switzerland .
91/14794 10/1991 WIPO .

*Primary Examiner*—Sikyin Ip
*Attorney, Agent, or Firm*—Gary M. Hartman; Domenica N. S. Hartman

[57] ABSTRACT

A corrosion-resistant and high tensile strength aluminum-based alloy consisting of, by weight, about 0.06–0.25% iron, 0.05–0.15% silicon, 0.03–0.08% manganese, 0.10–0.18% titanium, 0.10–0.18% chromium, up to 0.50% copper, up to 0.70% zinc, up to 0.02% incidental impurities, and the balance aluminum.

9 Claims, 2 Drawing Sheets

HIGH CORROSION RESISTANT ALUMINUM ALLOY CONTAINING TITANIUM

CROSS REFERENCE TO RELATED APPLICATIONS

This application claims the benefit of International Application No. PCT/EP98/04957, filed Jul. 10, 1998, and European patent application No. 97202234.7, filed Jul. 17, 1997.

BACKGROUND OF THE INVENTION

1. Field of the Invention

The invention relates to an improved aluminium alloy and more particularly to an aluminium alloy which contains controlled amounts of defined compounds and is characterized by the combination of high extrudability and high corrosion resistance.

2. Description of the Prior Art

In the automotive industry, aluminium alloys are used in a number of applications, especially for tubing because of the extrudability of the alloys combined with relatively high strength and low weight.

Especially useful are aluminium alloys for use in heat exchangers or air conditioning condensers. In this application the alloy must have a good strength, a sufficient corrosion resistance and good extrudability.

A typical alloy used in this application is AA 3102. Typically this alloy contains approximately 0.43% by weight Fe, 0.12% by weight Si and 0.25% by weight Mn.

In W097/46726 there is described an aluminium alloy containing up to 0.03% by weight copper; between 0.05–0.12% by weight silicon, between 0.1 and 0.5% by weight manganese, between 0.03 and 0.30% by weight titanium between 0.06 and 1.0% weight zinc, less than 0.01% by weight of magnesium, up to 0.50% by weight iron, less than 0.01% by weight nickel and up to 0.50% by weight chromium.

In WO97146726 it is claimed that there is no positive effect of Cr on the corrosion resistance. It should also be noted that in the same patent, the lower level of manganese is 0.1% by weight.

There is a constant need for having aluminium alloys, having the combination of excellent extrudability and superior corrosion resistance. Excellent extrudability is required to minimize production costs at the extrusion plant, including lower extrusion pressure and higher extrusion speeds.

BRIEF SUMMARY OF THE INVENTION

It is therefore an object of the invention to provide an aluminium alloy composition which exhibits superior corrosion resistance and improved extrudability while maintaining the strength of the at this moment commercial aluminium alloys. For that reason the aluminium alloy according to the present invention includes controlled amounts of iron, silicon, manganese, titanium, chromium and zinc.

It is a further object of the present invention to provide an aluminium-based alloy suitable for use in heat exchanger tubing extruded.

It is another object of the present invention to provide an aluminium-based alloy suitable for use as finstock for heat exchangers or in foil packaging applications, subjected to corrosion, for instance salt water.

These objects and advantages are obtained by an aluminium-based alloys, consisting of about 0.06–0.25% by weight of iron, 0.05–0.15% by weight of silicon up to 0.10% by weight of manganese, up to 0.25% by weight of titanium, up to 0.18% by weight of chromium, up to 0.50% by weight of copper, up to 0.70% by weight of zinc, up to 0.02% by weight of incidental impurities and the balance aluminium, said aluminium-based alloy exhibiting high corrosion resistance and high tensile strength.

Preferably the iron content of the alloy according to the invention is between about 0.06–0.15% by weight. In this way the corrosion resistance and the extrudability is optimal, as both characteristics are drastically decreasing with high iron content.

In order to optimize the resistance against corrosion, the titanium content is preferably between 0.10–0.18% by weight. In this range the extrudability of the alloy is practically not influenced by any change in the amount of titanium.

Preferably also the chromium content is between 0.10–0.18% by weight. An increase in chromium content results in an increased resistance against corrosion, but within this range the extrudability is slightly reduced but still within an acceptable range.

Zinc will in even small concentration, negatively affect the anodizing properties of AA 6000 alloys. In view of this polluting effect of zinc, the level of Zn should be kept low to make the alloy more recyclable and save costs in the cast house. Otherwise, zinc has a positive effect on the corrosion resistance up to at least 0.7% by weight, but for the reason given above the amount of zinc is preferable between 0.10–0.18% by weight.

Although copper may be present to up to 0.50% by weight, it is preferred to have the copper content below 0.01% by weight in order to have the best possible extrudability. In some circumstances it might be necessary to add copper to the alloy to control the corrosion potential, making the product less electro negative, to avoid galvanic corrosion attack of the product. It has been found that copper increases the corrosion potential with some 100 mV for each % of copper added, but at the same time decreases the extrudability substantially.

The invention also relates to an aluminium product obtained by means of extrusion and based upon an aluminium alloy according to the invention.

Normally after casting, the alloy this will be homogenized by means of an heat treatment at elevated temperatures, e.g. 550–610° C. during 3–10 hours. It has been found that by such a heat treatment the extrudability was slightly improved, but the corrosion resistance was negatively influenced.

According to the invention the aluminium product is characterized in that the only heat treatment of the aluminium alloy after casting is the preheating immediately before extrusion.

Such preheating takes place at lower temperatures than the homogenization step and only takes a few minutes, so that the characteristics of the alloy with respect to extrudability and corrosion resistance are hardly touched.

Other objects and advantages of this invention will be better appreciated from the following detailed description.

DETAILED DESCRIPTION OF THE INVENTION

Figure 1:
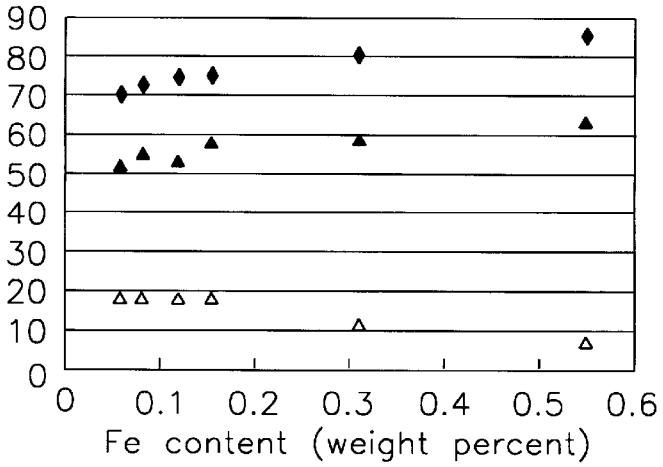
FIGS. 1 through 6 are graphs that evidence the influence that the iron, manganese, titanium, chromium, zinc and copper content, respectively, has on the properties of an aluminum alloy in accordance with the present invention.

In an effort to demonstrate the improvements associated with the inventive aluminium-based alloy over known prior art alloys, properties related to mechanical properties, corrosion resistance and extrudability were investigated.

The following description details the techniques used to investigate the properties and discussion of the results of the investigation.

A number of alloys according to the invention have been prepared, which alloys are listed below in table 1 the alloys A–I. In table 1 the composition of these alloys has been indicated in % by weight, taking into account that each of these alloys may contain up to 0.02% by weight of incidental impurities. In table 1 is also shown the composition of the traditional 3102-alloy.

All these alloys have been prepared in the traditional way. The extrusion of the billet after preparation of the alloy was preceded by a preheating to temperatures between 460–490° C.

TABLE 1

Chemical composition of the different alloys

| Alloy | Fe | Si | Mn | Ti | Cr | Zn |
|---|---|---|---|---|---|---|
| A | 0,10 | 0,08 | 0,06 | 0,08 | 0,00 | 0,00 |
| B | 0,14 | 0,08 | 0,08 | 0,13 | 0,00 | 0,04 |
| C | 0,12 | 0,08 | 0,08 | 0,25 | 0,00 | 0,19 |
| D | 0,12 | 0,08 | 0,08 | 0,23 | 0,00 | 0,18 |
| E | 0,14 | 0,10 | 0,08 | 0,15 | 0,00 | 0,51 |
| F | 0,10 | 0,08 | 0,08 | 0,14 | 0,00 | 0,70 |
| G | 0,13 | 0,07 | 0,08 | 0,20 | 0,03 | 0,18 |
| H | 0,13 | 0,07 | 0,04 | 0,13 | 0,01 | 0,18 |
| I | 0,12 | 0,07 | 0,04 | 0,13 | 0,13 | 0,18 |
| 3102 | 0,43 | 0,12 | 0,25 | | | |

In order to evaluate the improvements obtained by the alloys according to the invention, a number of tests were executed and the results thereof are shown in Table 2.

TABLE 2

Characteristics of the alloys shown in table 1

| Alloy | UTS | YS | Elong | Die force | Max force | SWAAT |
|---|---|---|---|---|---|---|
| A | 79,2 | 60,4 | 36,5 | 4751 | 5915 | 28 |
| B | 81,7 | 62,3 | 37,0 | 4982 | 6075 | 38 |
| C | 86,0 | 66,3 | 33,5 | 5053 | 6123 | 38 |
| D | 83,7 | 64,4 | 34,0 | 4624 | 5644 | 35 |
| E | 82,5 | 62,9 | 36,0 | 5039 | 6186 | 70 |
| F | 82,2 | 63,2 | 33,5 | 5015 | 6125 | 99 |
| G | 82,9 | 64,3 | 33,0 | 5072 | 6137 | 99 |
| H | 78,4 | 60,9 | 31,0 | 4890 | 5993 | 76 |
| I | 82,9 | 62,7 | 32,0 | 5024 | 6098 | 86 |
| 3102 | 86,2 | 65,5 | 37,2 | 5008 | 6025 | 10 |

For investigation of the properties of these alloys, a set of billets was cast and their composition determined by means of electron spectroscopy. For this analysis use was made of an instrument of make BAIRD VACUUM, and the standards used were supplied by Pechiney.

The extrudability is related to the die force and the maximum extrusion force indicated as max force. Those parameters are registered by pressure transducers mounted on the press, giving a direct read out of these values.

For determining the corrosion resistance of these alloys, use is made of the so-called SWAAT-test. The test sample was an extruded tube with a wall thickness of 0.4 mm. This test was performed according to ASTM-standard G85-85 Annex A3, with alternating 30 minutes spray periods and 90 minutes soak periods at 698% humidity. The electrolyte is artificial sea water acidified with acetic acid to a pH of 2.8 to 3.0 and a composition according to ASTM standard D1141. The temperature is kept at 49° C. The test was run in a Liebisch KTS-2000 salt spray chamber.

In order to study the evolution of corrosion behavior samples from the different materials were taken out of the chamber every third day. The materials were then rinsed in water and subsequently tested for leaks at a applied pressure of 10 bars. If e.g. a sample was found to be perforated after 35 days comparative samples were introduced in the chamber and left for 35 days before first inspection, in order to confirm the result. In the column SWAAT the number of days before perforation are indicated The test as described are in general use with the automotive industry, where an acceptable performance is qualified as being above 20 days.

The testing of mechanical properties was carried out on a Zweck Universal Testing Instrument (Module 167500) and in accordance with the Euronorm standard. In the testing the E-module was fixed to 70000 N/mm$^2$ during the entire testing. The speed of the test was constant at 10 N/mm$^2$ per second until Rp was reached, whilst the testing from Rp until fracture appeared was 40% Lo/min, Lo being the initial gauge length.

The results of table 2 show that both the mechanical properties, extrudability in terms of die force and maximum force as well as corrosion resistance are alloy dependent. First of all, the corrosion resistance of the alloys A–I is superior compared to the 3102 alloy. The extrudability is In general comparable to the 3102 alloy, but it is seen that for alloy A and D the extrudability is significant improved as compared to the 3102 alloy. The mechanical properties in terms of ultimate tensile strength, yield strength and % elongation are at the same level as the 3102 alloy. Some alloys have slightly reduced mechanical properties.

The best alloy combinations with respect to corrosion are observed to be when the Zn-content is kept relatively high, i.e. more than 0.5% by weight (alloy E and F), or when Cr is added in addition to Ti and Zn (alloys G, H and I). In case of alloy G, H and I the Zn-content is reduced to a level which is more suitable for use in cast houses, but the corrosion resistance for this alloy can match the corrosion resistance for the alloys having a much higher Zn-content.

It should therefore be emphasized that the optimum properties and especially the corrosion resistance is the result of the right combination of the elements Cr, Fe, Ti, Mn and Zn.

The corrosion test have been performed on samples taken at different location of the coil. About 10 samples were taken from the very start of the coil (from the front of the billet), 10 samples from the middle part of the coil (middle part of the billet) and 10 samples from the end of the coil (end of the billet). Each sample was about 50 cm long. The results were very consistent which means that there is no effects on the corrosion resistance related to extrusion speed and material flow during the extrusion of one billet, for the extrusion parameters used.

Additional work has been done to evaluate the effect of the different alloying elements, which is also shown in the annexed FIGS. 1–6, in which FIG. 1 shows the influence of the Fe-content on the characteristics of the alloy according to the invention.

Figure 2:
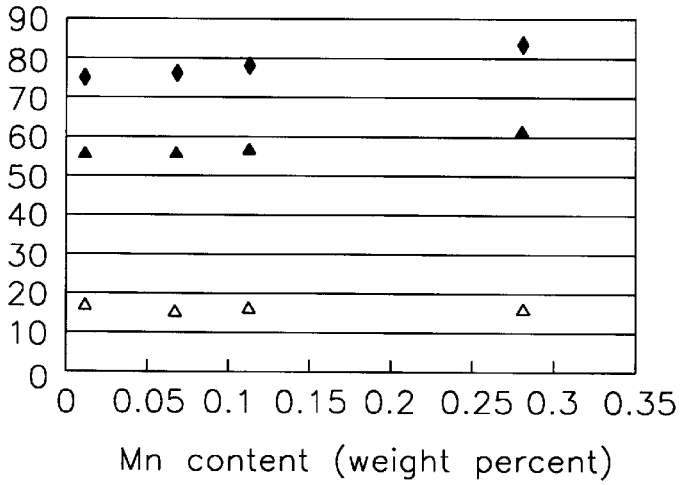

FIG. 2 shows the influence of the Mn-content on the characteristics of the alloy according to the invention.

Figure 3:
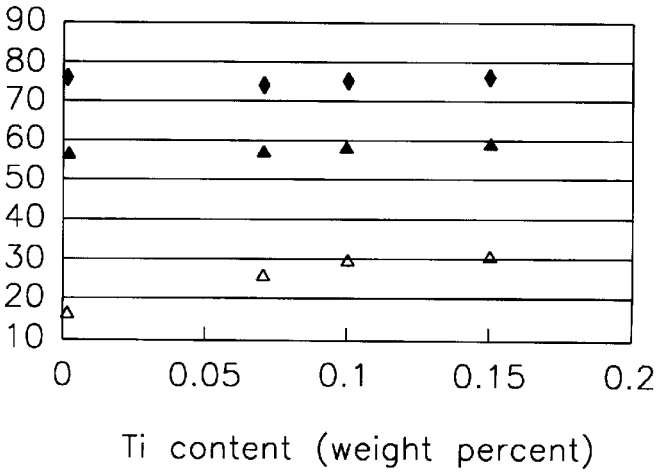

FIG. 3 shows the influence of the Ti-content on the characteristics of the alloy according to the invention.

Figure 4:
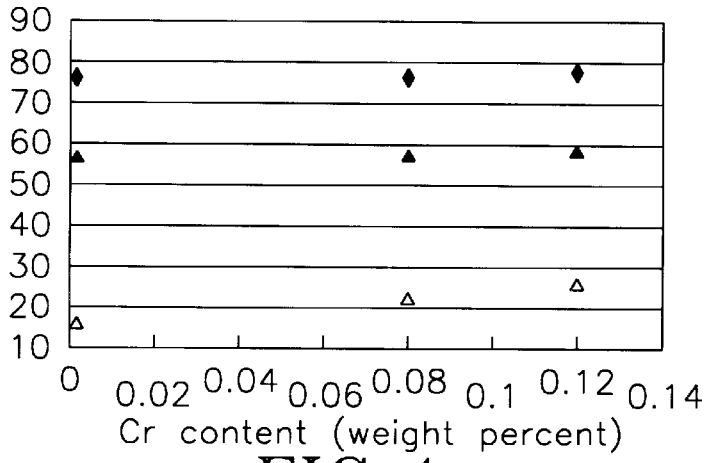

FIG. 4 shows the influence of the Cr-content on the characteristics of the alloy according to the invention.

Figure 5:
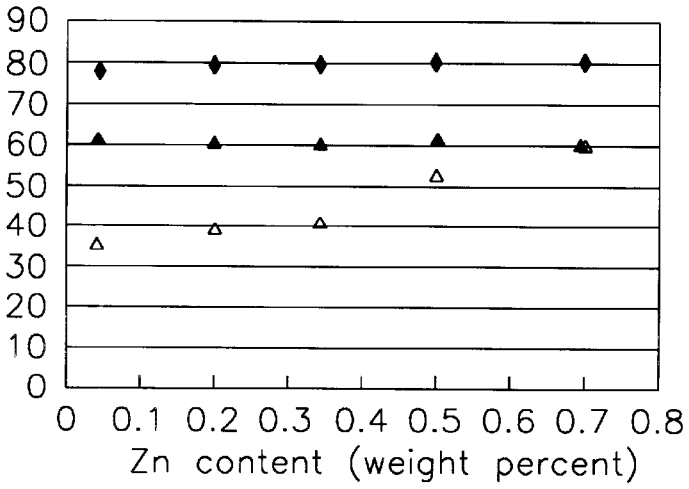

FIG. 5 shows the influence of the Zn-content on the characteristics of the alloy according to the invention.

Figure 6:
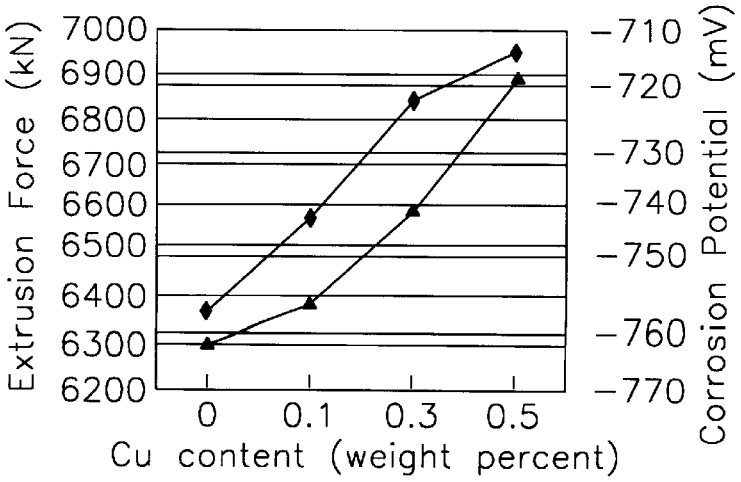

FIG. 6 shows the influence of the Cu-content on the characteristics of the alloy according to the invention.

In the FIGS. 1–5 the x-axis represents the content of the alloying agent expressed in % by weight, whereas the y-axis Is a relative representation of the different properties, the square dots being used to represent the ultimate tensile strength in MPa, the black triangular dots being used to represent the entrudability expressed in ktons and using the die force as representative measurement, and the white triangular dots being used to represent the SWAAT-test results expressed in days.

As shown in FIG. 1 the corrosion resistance is reduced in a significant way with higher Fe-contents (keeping Si-content at the same level of 0.08% by weight). This effect especially occurs at Fe-contents in the range of 0.2–0.3% by weight. At the same time the extrudability is significantly reduced with higher Fe-contents. It should be noted that a reduction of 2–3% of the extrudability (expressed as 2–3% increase of the break through pressure) is an unacceptable increase for an extrusion plant. Otherwise an Increase of the Fe-content results in an increase of the tensile strength.

As it becomes clear from FIG. 2, increasing the content of Mn above 0.10% by weight has practically no effect on the resistance against corrosion (keeping Fe and Si constant). An increase in the Mn-content results in a reduction of the extrudability and easily results in an unacceptable level. Otherwise the mechanical properties improve with an increase of the Mn-content. It is therefore preferred to keep the amount of Mn below 0.10% by weight to have the optimal balance between resistance against corrosion, extrudability and mechanical properties.

If Fe, Si and Mn are kept at a constant level of 0.15, 0.08 and 0.08% by weight, an increase of the Ti-content from 0.07 to 0.15% by weight will result in an improved resistance against corrosion as shown in FIG. 3. At the same time the extrudability is only decreased slightly, whereas the tensile strength is increased with 2–3 MPa.

The effect of changes in the Cr-content from 0.08 to 0.12% by weight, while maintaining Fe, Si and Mn at the same level as In FIG. 4, is that the corrosion resistance is increased, the extrudability is slightly reduced , and the mechanical properties somewhat increased.

The influence of Zn, while keeping Fe, Si, Ti and Mn at the same level 0.15, 0.08 and 0.08% by weight respectively, is practically zero with respect to the extrudability and the mechanical properties, but the corrosion resistance is increased with increased Zn-content.

The use of Cu is optional and dependent upon the actual use of the alloy. In FIG. 6 there is shown a diagram showing the influence of the Cu-content on the extrudability and on the corrosion potential. On the X-axis is shown the amount of Cu in % by weight, whereas the left Y-axis is the extrusion force expressed in kN and the right Y-axis is the corrosion potential expressed in mV according to ASTM G69. The upper line in the graph is the evolution of the corrosion potential, whereas the lower line is the evolution of the extrusion force.

From this graph it will be clear that a decreasing Cu-content results in a significant increase in extrudability, whereas an increase of Cu with 1% by weight makes the corrosion potential 100 mV less negative.

Normally it might be preferred to use an alloy with the smallest possible amount of copper, as copper has a negative influence of the inherent resistance against corrosion of the bare tube, and strongly influences the extrudability in a negative sense.

However in situations where the extruded product, such as a heat exchanger tube, must be connected to another product, such as a header with a clad containing no Zinc, it is possible by way of Cu additions to modify the corrosion potential of the extruded product in such a way that the tube becomes more noble (less negative) than the header material. This will curb any attacks of the tube due to galvanic corrosion.

While the invention has been described in terms of a preferred embodiment, it is apparent that other forms could be adopted by one skilled in the art. Accordingly, the scope of the invention is to be limited only by the following claims.

What is claimed is:

1. An aluminum-based alloy consisting of:

0.06–0.25% by weight of iron, 0.05–0.15% by weight of silicon, 0.03–0.08% by weight of manganese, 0.10–0.18% by weight of titanium, 0.10–0.18% by weight of chromium, up to 0.50% by weight of copper, up to 0.70% by weight of zinc, up to 0.02% by weight of incidental impurities, and the balance aluminum.

2. The alloy of claim 1, wherein said iron content ranges between 0.06–0.15% by weight.

3. The alloy of claim 1, wherein said manganese content ranges between 0.06–0.08% by weight.

4. The alloy of claim 1, wherein said titanium content is about 0.13% by weight.

5. The alloy of claim 1, wherein said chromium content is about 0.13% by weight.

6. The alloy of claim 1, wherein said zinc content ranges between 0.10–0.18% by weight.

7. The alloy of claim 1 wherein said copper content is below 0.01% by weight.

8. An aluminum product obtained by means of extrusion of the aluminum-based alloy of claim 1, characterized in that the only heat treatment of the alloy after casting is a preheating immediately before extrusion.

9. An aluminum-based alloy consisting of:

about 0.12% by weight of iron, about 0.07% by weight of silicon, 0.06–0.8% by weight of manganese, about 0.13% by weight of titanium, about 0.13% by weight of chromium, about 0.18% by weight of zinc, less than 0.01% by weight of copper, up to 0.02% by weight of incidental impurities, and the balance aluminum.

* * * * *